US008484831B2

(12) United States Patent
Piascik et al.

(10) Patent No.: US 8,484,831 B2
(45) Date of Patent: Jul. 16, 2013

(54) METHODS OF FORMING INSULATED WIRES AND HERMETICALLY-SEALED PACKAGES FOR USE IN ELECTROMAGNETIC DEVICES

(75) Inventors: James Piascik, Randolph, NJ (US); Reza Oboodi, Morris Plains, NJ (US); Robert Franconi, New Hartford, CT (US)

(73) Assignee: Honeywell International Inc., Morristown, NJ (US)

( * ) Notice: Subject to any disclaimer, the term of this patent is extended or adjusted under 35 U.S.C. 154(b) by 333 days.

(21) Appl. No.: 12/844,611

(22) Filed: Jul. 27, 2010

(65) Prior Publication Data

US 2012/0023870 A1 Feb. 2, 2012

(51) Int. Cl.
*H01F 7/06* (2006.01)

(52) U.S. Cl.
USPC ..... 29/606; 29/605; 29/608; 336/83; 336/175; 336/192; 336/200; 336/212; 264/250; 264/272.19

(58) Field of Classification Search
USPC ..... 29/602.1, 605, 606, 608; 264/250, 264/272.19; 336/83, 175, 192, 200, 212, 336/233
See application file for complete search history.

(56) References Cited

U.S. PATENT DOCUMENTS

| | | | | |
|---|---|---|---|---|
| 4,429,007 | A | 1/1984 | Bich et al. | |
| 4,813,424 | A * | 3/1989 | Wilkins | 600/345 |
| 5,636,434 | A | 6/1997 | Okey et al. | |
| 5,821,843 | A * | 10/1998 | Mamada et al. | 336/83 |
| 6,343,413 | B1 * | 2/2002 | Masuda et al. | 29/605 |
| 6,377,151 | B1 * | 4/2002 | Takayama et al. | 336/83 |
| 7,688,170 | B2 | 3/2010 | Pauley, Jr. et al. | |

* cited by examiner

*Primary Examiner* — Paul D Kim
(74) *Attorney, Agent, or Firm* — Ingrassia Fisher & Lorenz, P.C.

(57) ABSTRACT

A method includes coating a conductive wire with a paste comprising a first inorganic dielectric material, an organic binder, and a solvent to form a coated wire, drying the coated wire at a first drying temperature to remove at least a portion of the solvent and form a green wire, winding the green wire around a core to form a green assembly, heat treating the green assembly at a decomposing temperature above the first temperature and below a melting point of the first inorganic dielectric material to decompose the organic binder to form an intermediate assembly, and exposing the intermediate assembly to a densifying temperature that is above the decomposing temperature and substantially equal to or above the melting point of the first inorganic dielectric material to densify the dielectric material on the conductive wire.

20 Claims, 3 Drawing Sheets

METHODS OF FORMING INSULATED WIRES AND HERMETICALLY-SEALED PACKAGES FOR USE IN ELECTROMAGNETIC DEVICES

TECHNICAL FIELD

The inventive subject matter generally relates to wires for use in magnetic devices, and more particularly relates to forming an insulated wire.

BACKGROUND

Insulated wires are used in myriad applications. For instance, insulated wires may be used to create electromagnetic devices, such as motors. In particular, the wires can be wound around a magnetic core so that when current flows through the wires, a magnetic field is created to cause the core to move and produce a force. In other applications, the insulated wires may be used as part of a sensor, such as a linear variable differential transformer. Here, the wires make up a primary winding and a secondary winding that together define a coil assembly including an axial bore, and a magnetic core is disposed in the axial bore. The magnetic core moves axially within the axial bore and causes a differential current flow through the secondary winding.

Typically, the insulated wires are made from a conductive material that is coated with an electrically insulating material. The insulating material may be polyimide, polytetrafluoroethylene (PTFE), polyvinyl chloride (PVC) or another suitable material offering electrically insulative properties. These materials are applied to the wire via a spraying, drawing or electrolytic process. Polyimide insulated wires are relatively inexpensive and simple to manufacture and operate sufficiently under most circumstances. However, they have an upper continuous working temperature limit of about 240° C. In cases in which the insulated wires are exposed to temperatures greater than 240° C., the polyimide insulated wires are disposed in a protective housing, or are replaced with other types of insulated wires, such as PTFE-coated wires. PTFE can be used to increase the operating temperature to a working temperature of 260° C., but has a maximum excursion temperature near 300° C. Other insulating materials characterized by good dielectric properties, such as silicon oxides, may have temperature stability but cannot be bent or formed after the insulative material has been created. Thus, use of these types of insulated wires may be limited to applications in which space constraints are not a concern, where temperature can be controlled or where the wires can be formed and cured in the final application.

Accordingly, it is desirable to have an insulated wire that may be used in relatively high temperature environments (e.g., greater than about 240° C.) and may be bent into a desirable shape at any time after being coated with the insulation. Furthermore, other desirable features and characteristics of the inventive subject matter will become apparent from the subsequent detailed description of the inventive subject matter and the appended claims, taken in conjunction with the accompanying drawings and this background of the inventive subject matter.

BRIEF SUMMARY

Methods of forming insulated wires and hermetically sealed packages are provided.

In an embodiment, by way of example only, a method includes coating a conductive wire with a paste comprising a first inorganic dielectric material, an organic binder, and a solvent to form a coated wire, drying the coated wire at a first drying temperature to remove at least a portion of the solvent and form a green wire, winding the green wire around a core to form a green assembly, heat treating the green assembly at a decomposing temperature above the first temperature and below a melting point of the first inorganic dielectric material to decompose the organic binder to form an intermediate assembly, and exposing the intermediate assembly to a densifying temperature that is above the decomposing temperature and substantially equal to or above the melting point of the first inorganic dielectric material to densify the dielectric material on the conductive wire.

In another embodiment, by way of example only, a method of forming a hermetically sealed package includes coating a copper wire with a paste to form a coated wire, the paste comprising a first inorganic dielectric material, an organic binder, and a solvent, drying the coated wire at a first drying temperature to remove at least a portion of the solvent and form a green wire, winding the green wire around a core to form a green assembly, vacuum impregnating an outer layer material into the green assembly to decompose the organic binder to form an intermediate assembly, the outer layer material comprising a second dielectric material selected from a group consisting of the first dielectric material and overglaze material having a formulation that is different than the first dielectric material, drying the impregnated intermediate assembly at a second drying temperature in a vacuum or inert atmosphere to remove at least a portion of the solvent, exposing the impregnated intermediate assembly to a densifying temperature in a vacuum or inert atmosphere, wherein the densifying temperature is equal to or above the melting point of the first inorganic dielectric material to melt the first dielectric material on the conductive wire, and sealing the assembly within a cylinder in a vacuum or inert atmosphere to form the hermetically-sealed package.

BRIEF DESCRIPTION OF THE DRAWINGS

The inventive subject matter will hereinafter be described in conjunction with the following drawing figures, wherein like numerals denote like elements.

DETAILED DESCRIPTION

The following detailed description is merely exemplary in nature and is not intended to limit the inventive subject matter or the application and uses of the inventive subject matter. Furthermore, there is no intention to be bound by any theory presented in the preceding background or the following detailed description.

An improved insulated wire for use in an electromagnetic device component has been provided. The insulated wire includes a conductive wire and an inorganic dielectric coating. Generally, a process for forming the insulated wire includes coating a conductive wire with a paste comprising a first inorganic dielectric material, an organic binder, and a solvent to form a coated wire. The coated wire is dried at a drying temperature to remove the solvent and form a green wire. Then the green wire is wound around a core to form a green assembly. The green assembly is heat treated at a decomposing temperature above the drying temperature and below a melting point of the first inorganic dielectric material to decompose the organic binder to form an intermediate assembly. The intermediate assembly is then processed into an electromagnetic device, in an embodiment. In another embodiment, the intermediate assembly is exposed to a densifying temperature that is above the decomposing temperature and substantially equal to or above the melting point of the first inorganic dielectric material to densify the dielectric material on the conductive wire. In still another embodiment, rather than heat treating the green assembly at a decomposing temperature, the intermediate assembly is subjected to a sintering temperature that is substantially equal to or above a softening point of the first inorganic dielectric material to decompose the organic material in the green assembly to form an intermediate assembly. Next, the sintered intermediate assembly is then vacuum impregnated with a second dielectric material, heat treated at a decomposing temperature in the presence of oxygen, and exposed to a densifying temperature that is above the first decomposing temperatures and substantially equal to or above the melting point of the first and the second inorganic dielectric materials to densify the first and the second dielectric materials on the conductive wire.

Figure 1:
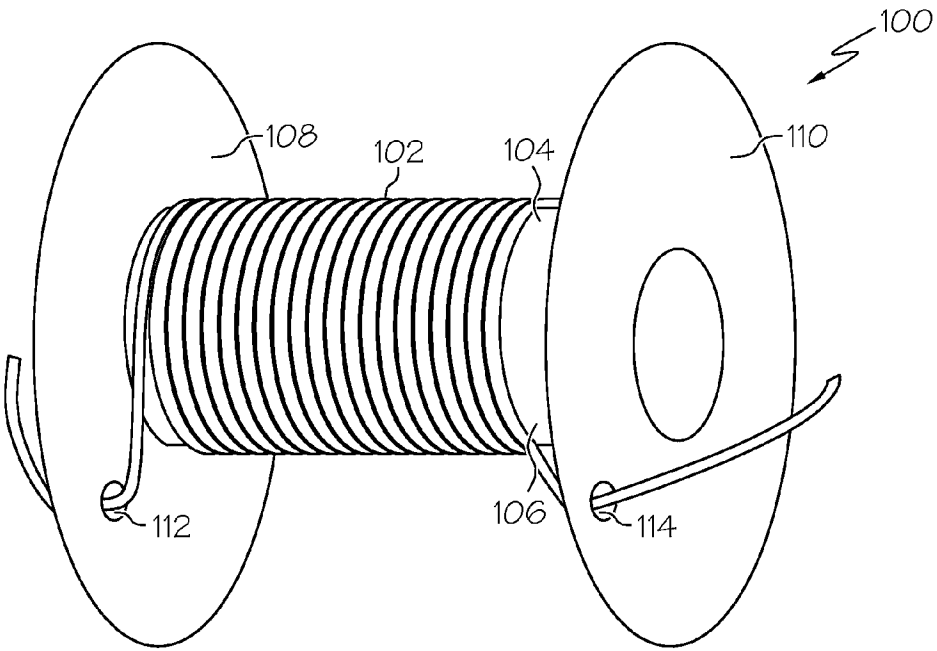
FIG. 1 is cross-sectional view of a simplified electromagnetic device component including insulated wires, according to an embodiment.

The insulated wire can be employed in a variety of different electromagnetic device components. FIG. 1 is a cross-sectional view of a simplified electromagnetic device component 100 that includes an insulated wire 102, according to an embodiment. The electromagnetic device component 100 is configured to be part of a motor, a position sensor, such as a linear variable differential transformer or a rotary variable differential transformer, a solenoid or another type of electromagnetic device component. The electromagnetic device component 100 includes a core 104 around which the insulated wire 102 is wound. The core 104 is made up of a non-ferromagnetic material, in embodiments in which the electromagnetic device component 100 is employed for a linear variable differential transformer, solenoid, and the like. Suitable non-ferromagnetic materials include, but are not limited to stainless steels, such as SS-302, SS-316, and SS-347. In embodiments in which the electromagnetic device component 100 is employed for a motor application, the core 104 is made up of a ferromagnetic material, such as a ferromagnetic stainless steel including, but not limited to SS-416 and SS-430. In any event, the particular material of the core 104 is selected to have a coefficient of thermal expansion that is substantially equal to that of a coating of the wire 102.

The core 104 includes a main body 106 and optionally, can include end walls 108, 110. The end walls 108, 110 are configured to retain the wire 102 on the core 104 and include through holes 112, 114 for the ends of the wire 102. To maintain the wire 102 in the through holes 112, 114, the ends are welded, glued or otherwise attached to the end walls 108, 110. Although the core 104 resembles a spool in FIG. 1, the core 104 can have a different configuration in other embodiments. For example, one or both of the end walls 108, 110 can be omitted. In another example, the core 104 includes additional components, such as a coil separating layer or tube, laminate stacks, a noncircular wire-form, and the like, which are not shown.

Figure 2:
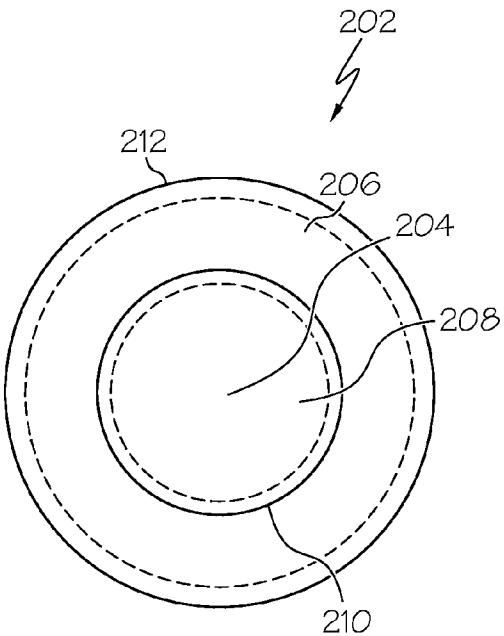
FIG. 2 is a simplified cross-sectional view of an insulated wire, according to an embodiment.

FIG. 2 is a cross-sectional view of a wire 202, in accordance with an embodiment. The wire 202 includes a conductor 204, a coating 206, and an optional overglaze 212. The conductor 204 may be any one of numerous conductive materials, including but not limited to metals, such as nickel, copper, silver, silver/palladium and alloys thereof. The conductor 204 may include a main body 208 that is made of a first conductive material and a layer 210 that is made of a second conductive material. The first conductive material may be formulated such that it is more conductive than the second conductive material, but may have a lower melting point than the second conductive material. In one example, the main body 208 may be copper, while the layer 210 may be nickel.

The coating 206 is disposed over and insulates the conductor 204, even when exposed to temperatures that may be greater than 300° C. The coating 206 comprises a dielectric material having a relatively low dielectric constant (e.g., a dielectric constant (K) that is less than 10. In another embodiment, the dielectric constant may be a value in a range of between about 1 and about 10. In embodiments in which the insulated wire 100 will be used in alternating current applications, the dielectric constant of the material may trend towards one (1).

Additionally, the material of the coating 206 is selected to have electrical and chemical properties that are compatible to those of the conductor 204. In particular, compatibility between the coating 206 and conductor 204 depends on various factors, including but not limited to coefficients of thermal expansion (CTE). A particular material employed for the coating 206 is selected for having a CTE that is substantially similar to that of the conductor 204. For example, the CTE of the conductor 204 may be in a range of about 13.5 ppm/° C. to about 19 ppm/° C., and the CTE of the coating 206 may be about 3 ppm/° C. less than the CTE of the conductor 204. By including a coating 206 having a lower thermal expansion than the conductor 204, a compression seal is formed between the coating 206 and conductor 204, instead of a tension seal. Additional considerations for material selection include desired acceptable breakdown voltage of the resulting insulated wire, bonding mechanisms between the coating 206 and conductor 204, and chemical compatibility between the coating 206 and conductor 204 materials.

Suitable dielectric materials having the aforementioned properties include, but are not limited to glasses, such as dielectric glasses comprising one or more constituents including, but not limited to, silicon oxide, lanthanum oxide, aluminum oxide, boron oxide, zinc oxide, zirconium oxide, yttria, cobalt alumina or one or more alkaline earth metal oxides, including but not limited to barium oxide, magnesium oxide, calcium oxide, and strontium oxide. Commercial glasses including one or more of the aforementioned constituents include, but are not limited to glass pastes such as ESL-3916 available through Electro-Science Laboratories of King of Prussia, Pa., any one of DL13-372, DL13-389, OG15-364, and OG15-339 available through Ferro of Cleveland, Ohio, Cermalloy SD-2000 available through Heraeus Cermalloy, Inc. of Conshohocken, Pa., and DuPont 3500N available through E.I. DuPont de Nemours of Delaware. Other dielectric materials include dielectric glasses doped with ceramic, where the ceramic is employed as a filler to promote crystallization of the dielectric glass. Suitable ceramics include, but are not limited to barium titanate, forsterite, alumina, zirconia, zinc oxide, and the like. The coating 206 can have a thickness in a range of about 0.025 mm to about 0.10 mm, but may be thicker or thinner than the aforementioned range in other embodiments.

The overglaze 212 is included to reduce the likelihood of crack formation in the coating 206. In this regard, the overglaze 212 is selected to have dielectric properties and to serve as an encapsulant surrounding the coating 206. Suitable materials from which the overglaze 212 can comprise include, but are not limited to the dielectric materials used for the formation of the coating 206 and other materials employed to encapsulate dielectrics, such as Ferro OG15-464, which is available through Ferro Corporation of Cleveland, Ohio. The overglaze 212 can have a thickness in a range of about 2.54 mm to about 254 mm; however, in other embodiments, the overglaze 212 may be thicker or thinner than the aforementioned range.

Figure 3:
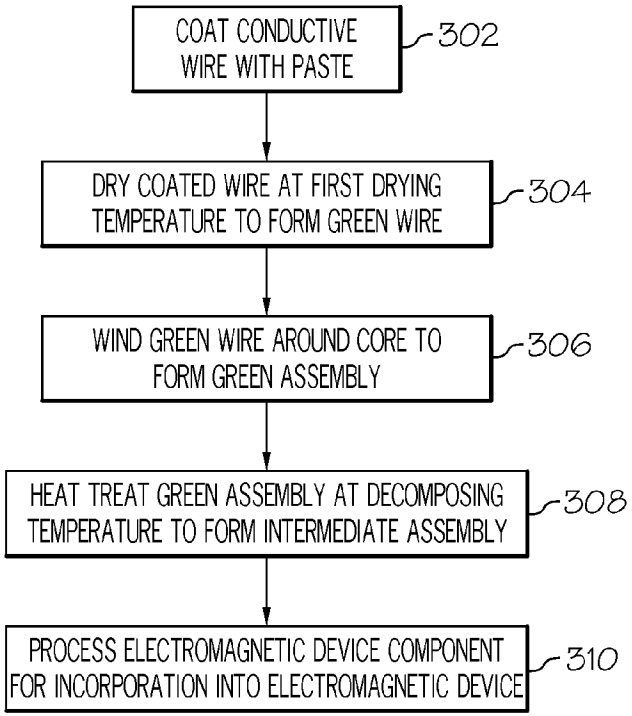
FIG. 3 is a method of manufacturing a flexible insulated wire, according to an embodiment.

To form the insulated wire, a method 300 depicted in the flow diagram of FIG. 3, is employed. The method 300 includes coating a conductive wire with a paste to form a coated wire, step 302. The conductive wire is a material selected from a material mentioned above in conjunction with the conductor 204. The paste comprises an inorganic dielectric material, an organic binder, and a solvent. The inorganic dielectric material comprises one or more of the materials selected from the materials mentioned above in conjunction with the coating 206. The organic binder may be selected from acrylic, polyvinyl alcohol, polyethylene oxide or another type of organic binder that is soluble in a solvent system. The solvent comprises alcohol (alpha terpineol), water or another liquid that may be added to the paste to decrease the viscosity of the paste. The paste includes about 20% to about 90% of the inorganic dielectric material, about 2% to about 30% of the organic binder, and about 10% to about 90% of the solvent. In other embodiments, more or less of the inorganic dielectric material, organic binder, and/or solvent is included in the paste.

In an example of step 302, the paste is formed from a commercial inorganic dielectric material, such as ESL-3916 available through Electro-Science Laboratories of King of Prussia, Pa., any one of DL13-372, DL13-389, OG15-364, and OG15-339 available through Ferro of Cleveland, Ohio, Cermalloy SD-2000 available through Heraeus Cermalloy, Inc. of Conshohocken, Pa., DuPont 3500N available through E.I. DuPont de Nemours of Delaware or any other inorganic dielectric material that is electrically and chemically compatible with the conductor 206. In some cases, the commercial inorganic dielectric material includes a binder, such as about 2% to about 3% ethyl cellulose. However, to increase bendability of the coating 206 formed from the dielectric material, additional organic binder is added to the paste. For example, an amount of the organic binder is added so that the paste comprises 4% to about 30% organic binder and a balance of the inorganic dielectric material when dried. To control viscosity of the paste, a solvent is added to the inorganic dielectric material. In other embodiments, a smaller or larger amount of one or both of the organic binder and/or solvent are added.

The paste is applied to the conductive wire in thin layers (e.g., layers having a thickness in a range of about 0.1 mm to about 0.2 mm) About fifteen (15) to thirty (30) layers are applied to form a coating having a total thickness in a range of about 5 millimeters to about 20 mm. In other configurations, the thickness of the coating is greater or less than the aforementioned range and/or the number of applied layers is greater or less than the aforementioned range.

The particular process by which the paste is applied depends on a desired maximum thickness of each layer forming the coating. For example, to produce the thin layers mentioned above, the conductive wire can be drawn through a porous pad impregnated with the paste. The porous pad can comprise a felt pad, a sponge or another pad. The porous pad is included as part of a paste application system having a paste source and pump providing the paste to the porous pad, and an actuator configured to draw the conductive wire between surfaces of the porous pad. The paste application system can include more than one set of porous pads disposed in series, where each set of porous pads is used to apply a layer. Alternatively, a single felt pad or pad assembly can be employed to form a layer on the conductive wire, and the coated conductive wire is re-inserted through the single porous pad or pad assembly a particular number of times to thereby form the desired number of layers in the coated wire.

The coated wire is dried at a first drying temperature to remove the solvent and form a green wire, step 304. As used herein, the term "drying temperature" is a temperature that is sufficient to remove at least a portion of solvent to thereby form a "green wire". Drying occurs after each layer is formed. The coated wire is positioned within a drying oven and baked at temperatures suitable for removing at least a portion of the solvent in the wire. Preferably, substantially all of the solvent (e.g., >95%) in the coated wire is removed. The first drying temperature is in a range of about 50° C. to about 350° C., and the coated wire is dried for a time period of one or two seconds to 10 minutes. The coated wire can be dried at a higher temperature for a shorter duration and at a lower temperature for a longer duration. In another embodiment of step 304, the coated wire is dried for longer or shorter durations at lower or higher temperatures than those in the aforementioned ranges. After baking, the coated wire comprises the inorganic dielectric material and organic binder to thereby form the green wire.

Next, the green wire is wound around a core or wire-form to form a green assembly, step 306. As used herein, the term "green assembly" is defined as the assembly formed by the core and green wire wrapped around the core. The core is configured substantially similar to core 104 of FIG. 1. Depending on the type of application the wire is to be used for, the core can be pre-coated with a dielectric material. Pre-coating the core with the dielectric material is useful for maximizing an electrical breakdown potential of the core. The dielectric material for the pre-coating can be a material similar to that employed in the paste. Alternatively, the dielectric material for the pre-coating can be made up of a different glass dielectric or ceramic doped glass dielectric. To provide an effective pre-coating, the pre-coating has a thickness in a range of about 5 mm to about 20 mm, generally. However, in other embodiments, the pre-coating is thinner or thicker than the aforementioned range, as the particular thickness selected depends on a desired breakdown voltage of the resulting insulated wire.

In embodiments in which the core has an end wall (e.g., end wall 108, 110 of FIG. 1), an end of the green wire is inserted into a through hole (e.g., through hole 112, 114 of FIG. 1) of the end wall. The green wire is then wound around the core until a desired number of turns are formed. If the core has a second end wall, a second end of the green wire is inserted through a through hole of the second end wall.

The green assembly is heat treated at a first decomposing temperature to decompose the organic binder and form an intermediate assembly, step 308. As used herein, the term "first decomposing temperature" is a temperature above the drying temperature and below a melting point of the first inorganic dielectric material. The term "melting point" is defined as a temperature at which a solid of the first inorganic dielectric material becomes a liquid. Preferably, the first decomposing temperature is sufficient to remove substantially all (e.g., ≧95%) of the organic binder (or other organic material) from the green assembly. The organic binder and/or organic material are removed to decrease a presence of carbon in the green assembly, which if included could affect performance of the wire. For example, the green assembly may be placed in an oven and exposed to first decomposing temperatures in a range of about 350° C. to about 450° C. or to temperatures greater or less than the aforementioned range. In embodiments in which the wire comprises copper, the green assembly is disposed in the presence of oxygen and heated. In some cases, the decomposing temperatures are lower than the aforementioned range and step 308 is performed for a longer duration. After heat treating, dielectric material remains in the coating of the wire in the green assembly.

The intermediate assembly is processed for incorporation into an electromagnetic device, step 320. In an embodiment, the sections of the insulated wire disposed in the through holes of the core are attached to the end walls. For example, the through holes are filled with glass material, a ceramic material or another material suitable for attaching the wires to the end walls, and the material is melted and cooled to maintain the wires in the through holes. In another embodiment, the electromagnetic device component includes insulated wires comprising a copper (Cu) conductor, which are preferably placed in a hermetically-sealed package. In this regard, the electromagnetic device component is disposed in a vacuum or inert environment and placed into a suitably configured cylinder. The edges of the end walls or seams of the cylinder are welded together to form the hermetically-sealed package. The cylinder comprises stainless steel similar to that used for forming the core or another non-magnetic material.

Figure 4:
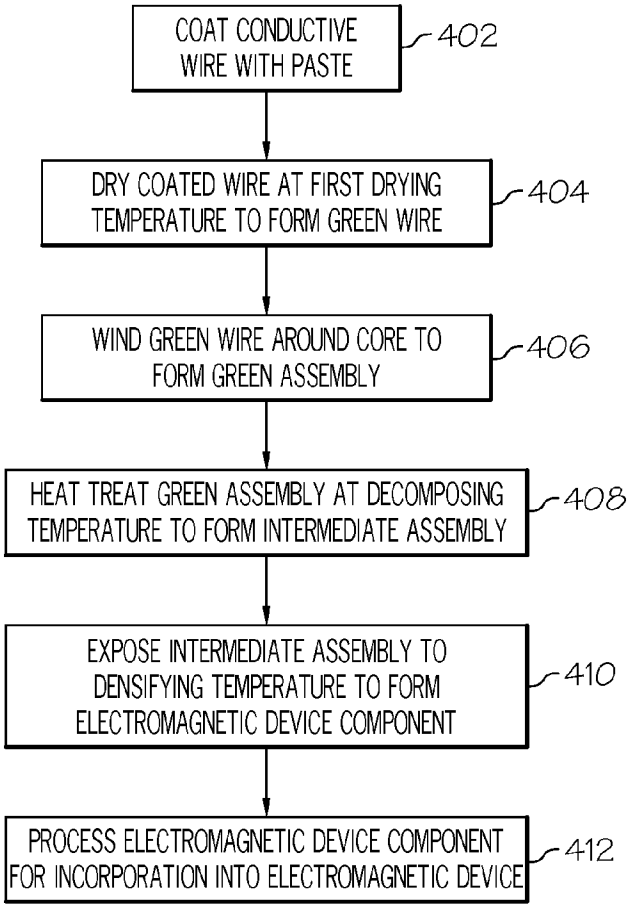
FIG. 4 is a method of manufacturing a flexible insulated wire, according to another embodiment.

FIG. 4 is a flow diagram of a method 400 of forming the insulated wire, according to another embodiment. The method 400 includes coating a conductive wire with a paste to form a coated wire, step 402. The coated wire is dried at a first drying temperature to remove the solvent and form a green wire, step 404. Next, the green wire is wound around a core or wire-form to form a green assembly, step 406. The green assembly is heat treated at a first decomposing temperature to decompose the organic binder and form an intermediate assembly, step 408. Steps 402 through 408 are substantially similar to steps 302 through 308 described above.

Method 400 also includes exposing the intermediate assembly to a densifying temperature to form an electromagnetic device component, step 410. As used herein, the term "densifying temperature" is a temperature suitable for causing the dielectric material to densify. Densifying the dielectric material improves moisture- and oxidation-resistance properties of the electromagnetic device component. The densifying temperature is above the drying temperature and substantially equal to or above the melting point of the first inorganic dielectric material. The densifying temperature can be in a range of about 800° C. to about 850° C., and the intermediate assembly can be densified for a period of time in a range of about 2 minutes to about 1 hour. In other embodiments, the densifying temperature and duration is greater or less than the aforementioned ranges, depending on the particular composition of the dielectric material on the wire. Densification can be performed in the oven in which the intermediate assembly is dried, or the intermediate assembly can be transferred to another oven.

After densification, the electromagnetic device component is processed for incorporation into an electromagnetic device, step 412. Step 412 is performed in substantially the same manner as step 310 described above.

Figure 5:
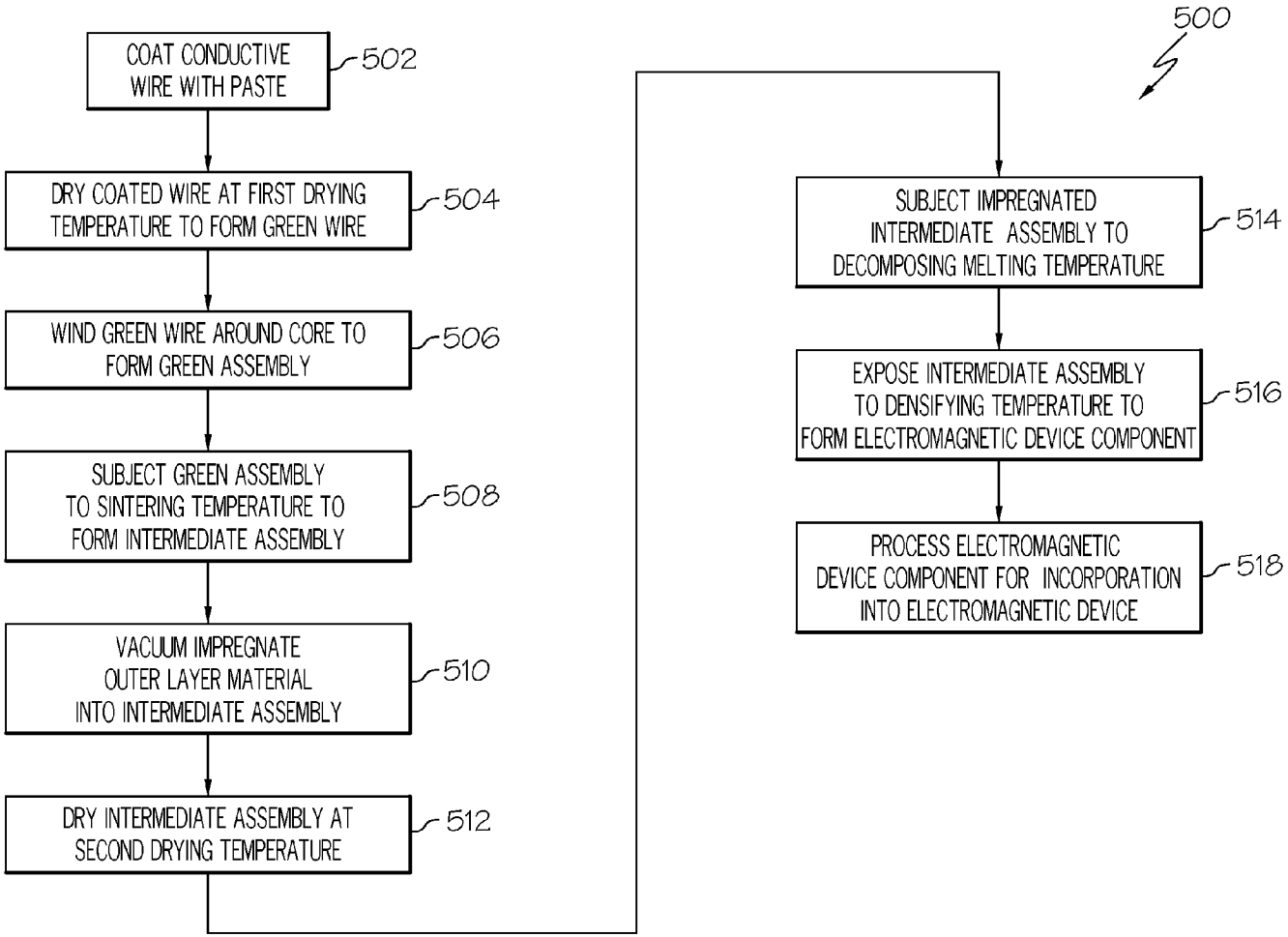
FIG. 5 is a method of manufacturing a flexible insulated wire, according to still another embodiment.

FIG. 5 is a flow diagram of a method 500 of forming the insulated wire, according to still another embodiment. The method 500 includes coating a conductive wire with a paste to form a coated wire, step 502. The coated wire is dried at a first drying temperature to remove the solvent and form a green wire, step 504. Next, the green wire is wound around a core or wire-form to form a green assembly, step 506. Steps 502 through 506 are substantially similar to steps 302 through 306 described above.

Next, the green assembly is subjected to a sintering temperature to decompose the organic material included in the green assembly to thereby form an intermediate assembly, step 508. As used herein, the "sintering temperature" is a temperature that is substantially equal to a softening point temperature of the first inorganic dielectric material ±10° C. of the first inorganic dielectric material. The term "softening point" is defined as a temperature at which a viscous flow changes to plastic flow for a substance without a definite melting point. Thus, the particular sintering temperature depends on the particular material used as the first inorganic dielectric material. In embodiments in which the wire comprises copper, the green assembly is disposed in the presence of oxygen and heated to the sintering temperature. Step 508 can be performed for about 5 minutes to about 20 hours, in an embodiment. In another embodiment, step 508 is performed for about 4 hours to about 6 hours. Step 508 is performed in a vacuum environment when the conductor included in the intermediate assembly comprises copper or another metal or when further impregnation of the first inorganic dielectric material is desired. In another embodiment, step 508 is performed in air or in an inert atmosphere, such as in a nitrogen atmosphere.

In embodiments in which an overglaze is included over the coating, an outer layer material is vacuum impregnated into the intermediate assembly, step 510. The outer layer material comprises a dielectric material, which can be selected from the first dielectric material from which the coating is made and an overglaze material having a formulation that is different than the first dielectric material. For example, the overglaze material can comprise a dielectric material having a melting point that is about 150° C. less than that of the coating so that the overglaze material substantially seals voids that may be present in the intermediate assembly. Suitable overglaze materials include, but are not limited to those noted above in relation to overglaze 212.

The outer layer material can be in a paste form and may include a solvent to thin its viscosity, or may be in a paint form. In any case, the outer layer material is applied over outer surfaces of the coated wires by spraying, painting, brushing, dipping, and the like. A thickness in a range of about 0.002 cm to about 0.200 cm of the outer layer material may be disposed over the coated wires. The intermediate assembly including the outer layer material disposed thereon is placed within a vessel and subjected to a vacuum atmosphere. As a result, the outer layer material is forced into voids or cracks that may be present in the coating after the intermediate assembly is heat treated.

The coating, impregnated with the outer layer material, is then dried at a second drying temperature, step 512. The impregnated intermediate assembly is positioned within a drying oven or in the equipment in which step 510 is performed, with or without rotation in the oven, and baked at drying temperatures suitable for removing at least a portion of the solvent (preferably, substantially all of the solvent (e.g., >95%)) present in the impregnated intermediate assembly. The second drying temperature of step 512 may be substantially equal to (e.g., ±5° C.) to the first drying temperature of step 504. For example, the second drying temperature is in a range of about 50° C. to about 300° C. Drying can occur for a time period of about one or two seconds to 10 minutes. The impregnated intermediate assembly can be dried at a higher temperature for a shorter duration or at a lower temperature for a longer duration. In another embodiment of step 312, the impregnated intermediate assembly is dried for longer or shorter durations at lower or higher temperatures than those in the aforementioned ranges.

After drying, the impregnated intermediate assembly is fired at a decomposing temperature to decompose any organic material in the outer layer material, step 514. As used herein, the term "decomposing temperature" is a temperature above the second drying temperature and below a melting point of the outer layer material. Preferably, the decomposing temperature is sufficient to remove substantially all (e.g., ≧95%) of the organic binder from the impregnated intermediate assembly. For example, the impregnated intermediate assembly may be placed in an oven and exposed to decomposing temperatures in a range of about 350° C. to about 450° C. or to temperatures greater or less than the aforementioned range. After heat treating, dielectric material remains in the coating of the wire in the green assembly to form the overglaze.

Regardless of whether the overglaze is included over the intermediate assembly, the intermediate assembly is exposed to a densifying temperature to form an electromagnetic device component, step 516. As used herein, the term "densifying temperature" is a temperature suitable for causing the dielectric material to densify. Densifying the dielectric material improves moisture- and oxidation-resistance properties of the electromagnetic device component. The densifying temperature is above the drying temperature and substantially equal to or above the melting point of the first inorganic dielectric material. The densifying temperature can be in a range of about 800° C. to about 850° C., and the intermediate assembly can be densified for a period of time in a range of about 2 minutes to about 1 hour. In other embodiments, the densifying temperature and duration is greater or less than the aforementioned ranges, depending on the particular composition of the dielectric material on the wire. Densification can be performed in the oven in which the intermediate assembly is dried, or the intermediate assembly can be transferred to another oven.

After densification, the electromagnetic device component is processed for incorporation into an electromagnetic device, step 518. Step 518 is performed in substantially the same manner as step 310 described above.

By forming the coating (and overglaze, if included) over the conductive wire according to the process described above, an insulated wire is produced that can be used in temperature environments greater than about 240° C. Moreover, the insulated wire produced by the above-described process has reduced porosity and improved moisture protection over conventionally-produced insulated wire. Additionally, because the wire is wound around the core prior to densification, minimal bending is required during device assembly, which reduces a likelihood of the coating cracking. The above-mentioned process is relatively inexpensive and simple to perform.

While at least one exemplary embodiment has been presented in the foregoing detailed description of the inventive subject matter, it should be appreciated that a vast number of variations exist. It should also be appreciated that the exemplary embodiment or exemplary embodiments are only examples, and are not intended to limit the scope, applicability, or configuration of the inventive subject matter in any way. Rather, the foregoing detailed description will provide those skilled in the art with a convenient road map for implementing an exemplary embodiment of the inventive subject matter. It being understood that various changes may be made in the function and arrangement of elements described in an exemplary embodiment without departing from the scope of the inventive subject matter as set forth in the appended claims.

What is claimed is:

1. A method of forming an insulated wire, comprising:

coating a conductive wire with a paste comprising a first inorganic dielectric material, an organic binder, and a solvent to form a coated wire;

drying the coated wire at a first drying temperature to remove at least a portion of the solvent and form a green wire;

winding the green wire around a core to form a green assembly; and heat treating the green assembly at a first decomposing temperature above the first temperature and below a first melting point of the first inorganic dielectric material to decompose the organic binder to form an intermediate assembly.

2. The method of claim 1, wherein the step of coating comprises impregnating a porous pad with the paste and drawing the conductive wire through the impregnated porous pad to form the coated wire.

3. The method of claim 2, further comprising repeating the step of drawing the conductive wire through the impregnated porous pad to form a plurality of layers of the paste.

4. The method of claim 1, wherein the conductive wire comprises a material selected from a group consisting of nickel, copper, silver, and silver/palladium.

5. The method of claim 1, wherein the inorganic dielectric material comprises a material selected from a group consisting of a glass dielectric, a ceramic dielectric, and a combination thereof.

6. The method of claim 1, wherein the organic binder comprises a binder selected from a group consisting of acrylic, polyvinyl alcohol, and polyethylene oxide.

7. The method of claim 1, wherein the first decomposing temperature is in a range of about 350° C. to about 450° C.

8. The method of claim 1, wherein the conductive wire comprises copper and the step of heat treating the green assembly comprises performing the heat treating in the presence of oxygen.

9. The method of claim 1, further comprising heating the intermediate assembly to a predetermined elevated temperature exceeding the first decomposing temperature and substantially equal to or exceeding the softening point of the first inorganic dielectric material.

10. The method of claim 9, wherein the predetermined elevated temperature is a densifying temperature substantially equal to or exceeding the melting point of the first inorganic dielectric material, and wherein the step of heating comprises heating the intermediate assembly to the densifying temperature to melt the first inorganic dielectric material on the conductive wire.

11. The method of claim 10, wherein the densifying temperature is in a range of about 800° C. to about 850° C.

12. The method of claim 9, wherein the predetermined elevated temperature is a sintering temperature less than the melting point of the first inorganic dielectric material, and wherein the step of heating comprises heating the intermediate assembly to the sintering temperature to sinter the first inorganic dielectric material on the conductive wire.

13. A method of forming a hermetically-sealed package for an electromagnetic device, the method comprising:

coating a copper wire with a paste to form a coated wire, the paste comprising a first inorganic dielectric material, an organic binder, and a solvent;

drying the coated wire at a first drying temperature to remove at least a portion of the solvent and form a green wire;

winding the green wire around a core to form a green assembly;

subjecting the green assembly to a sintering temperature that is substantially equal to a softening point temperature of the first inorganic dielectric material to decompose the organic binder and form an intermediate assembly;

vacuum impregnating an outer layer material into the intermediate assembly, the outer layer material comprising a second dielectric material selected from a group consisting of the first dielectric material and overglaze material having a formulation that is different than the first dielectric material, the second dielectric material having a melting point and including an organic material;

drying the impregnated intermediate assembly at a second drying temperature in a vacuum or inert atmosphere to remove at least a portion of the solvent;

heating the dried impregnated intermediate assembly at a decomposing temperature that is above the second drying temperature and below the second melting point of the second dielectric material to decompose the organic material of the second dielectric material;

exposing the impregnated intermediate assembly to a densifying temperature in a vacuum or inert atmosphere, wherein the densifying temperature is equal to or above the melting point of the first and the second inorganic dielectric material to melt the first and the second dielectric material on the conductive wire; and sealing the assembly within a cylinder in a vacuum or inert atmosphere to form the hermetically-sealed package.

14. The method of claim 13, further comprising the step of pre-coating the core with the first dielectric material.

15. The method of claim 13, wherein the core includes an end wall including a feed-through hole, and the method further comprises inserting an end of the green wire through the feed-through hole before the step of heat treating.

16. The method of claim 15, wherein the step of sealing comprises welding the cylinder to the end wall.

17. The method of claim 15, further comprising filling the feed-through hole with a glass material after the step of exposing the impregnated green assembly and before the step of sealing.

18. The method of claim 13, wherein the inorganic dielectric material comprises a material selected from a group consisting of a glass dielectric, a ceramic dielectric, and a combination thereof.

19. The method of claim 13, wherein the organic binder comprises a binder selected from a group consisting of acrylic, polyvinyl alcohol, and polyethylene oxide.

20. The method of claim 13, wherein:

the conductive wire comprises copper and the step of heat treating the green assembly comprises performing the heat treating in the presence of oxygen.

* * * * *